US011160394B1

(12) United States Patent
Luberto et al.

(10) Patent No.: US 11,160,394 B1
(45) Date of Patent: Nov. 2, 2021

(54) FACILITATING THE PLACEMENT OF SHELVING IN A MERCHANDISE DISPLAY AND DISPENSING UNIT

(71) Applicant: Henschel-Steinau, Inc., Allendale, NJ (US)

(72) Inventors: Michael D. Luberto, River Vale, NJ (US); Andrew B. Sholl, New York, NY (US)

(73) Assignee: Henschel-Steinau, Inc., Allendale, NJ (US)

( * ) Notice: Subject to any disclaimer, the term of this patent is extended or adjusted under 35 U.S.C. 154(b) by 53 days.

(21) Appl. No.: 16/591,924

(22) Filed: Oct. 3, 2019

(51) Int. Cl.
*A47F 5/10* (2006.01)
*A47B 57/10* (2006.01)
*A47F 5/00* (2006.01)

(52) U.S. Cl.
CPC ..... *A47F 5/103* (2013.01); *A47B 57/10* (2013.01); *A47F 5/0043* (2013.01)

(58) Field of Classification Search
CPC ..... A47F 5/103; A47F 5/0043; A47L 57/10
See application file for complete search history.

(56) References Cited

U.S. PATENT DOCUMENTS 597,186 A 1/1898 Hunter
2,894,670 A 7/1959 Anderson et al.
3,172,715 A 3/1965 Powder
3,610,174 A 10/1971 Kesling
3,982,801 A * 9/1976 Heidorn ..... A47B 57/06 312/306
4,026,222 A 5/1977 Mueller
4,919,282 A 4/1990 Duff et al.
5,117,986 A * 6/1992 Lin ..... A47B 57/20 108/2
5,913,584 A 6/1999 Swindell et al.
5,970,887 A 10/1999 Hardy
6,024,025 A * 2/2000 Koch ..... A47B 9/04 108/147
6,065,821 A * 5/2000 Anderson ..... A47B 57/06 108/108
7,178,890 B2 2/2007 Park et al.
7,611,111 B2 11/2009 Costa et al.
8,047,623 B2 * 11/2011 Kang ..... A47B 57/06 312/408

(Continued)

*Primary Examiner* — Stanton L Krycinski
(74) *Attorney, Agent, or Firm* — Richard M. Goldberg

(57) ABSTRACT

Apparatus and method facilitate placement of shelves at selected levels in a merchandise display and dispensing unit. At least one shelf is secured in place in a horizontal, level orientation at a selected level to locate a point-of-purchase at a selected height within the unit. A locking mechanism located adjacent a distal edge of the shelf locks the shelf at the selected level and is operated by an actuator extending essentially from adjacent one to adjacent the other end of the shelf, beneath the shelf, conveniently accessible by an operator from a proximal edge of the shelf while supporting the shelf in an essentially balanced manner so as to enable manual movement for relocating the shelf to the selected level without disturbing items placed on the shelf. A leveling system is coupled to the shelf to maintain the shelf in the horizontal, level orientation during movement, and a damper mechanism impedes accelerated downward movement of the shelf when unlocked for selected relocation.

10 Claims, 6 Drawing Sheets

(56) References Cited

U.S. PATENT DOCUMENTS

| | | | | |
|---|---|---|---|---|
| 8,152,258 | B2 | 4/2012 | Kang et al. | |
| 8,172,347 | B2 * | 5/2012 | Lim | F25D 25/02 312/408 |
| 8,226,184 | B2 | 7/2012 | Kang et al. | |
| 8,333,448 | B2 | 12/2012 | Yoon et al. | |
| 8,602,230 | B2 * | 12/2013 | Bergdoll | A47B 57/16 211/187 |
| 8,607,997 | B2 * | 12/2013 | Bergdoll | A47F 5/08 211/187 |
| 8,950,603 | B2 | 2/2015 | Davis et al. | |
| 9,109,804 | B2 * | 8/2015 | Armstrong | A47B 57/10 |
| 9,277,820 | B2 | 3/2016 | Jacob et al. | |
| 9,593,878 | B2 | 3/2017 | Celik et al. | |
| 2008/0251483 | A1 * | 10/2008 | Davis | A47F 5/0018 211/187 |

* cited by examiner

FACILITATING THE PLACEMENT OF SHELVING IN A MERCHANDISE DISPLAY AND DISPENSING UNIT

The present invention relates generally to the display and dispensing of merchandise presented at a point-of-purchase provided by shelving in a display and dispensing unit and pertains, more specifically, to apparatus and method for facilitating selection of the vertical level of the shelves of such units to place corresponding points-of-purchase at selected heights within such a unit.

It has become quite common in retail venues to display and dispense merchandise from shelving units in which a variety of items of merchandise is placed on shelves that present the items at a point-of-purchase. One of the most ubiquitous of such shelving units is that known as a "gondola" in which multiple longitudinally extending shelves are mounted in cantilever fashion to project laterally from distally placed vertical members toward a point-of-purchase juxtaposed with a proximal edge of each shelf. Each shelf is located at a vertical height usually dictated by vertical dimensions of the items of merchandise to be displayed on the shelf.

When it is desired to change the height of a gondola shelf, perhaps to accommodate the vertical dimensions of items either placed or to be placed upon that shelf, or to establish a more prominent or less prominent display positioning of the items, the usual procedure is to uncouple the shelf from the vertical members to enable manual movement of the shelf to the desired position where the shelf, once again, is coupled to the vertical members. That operation ordinarily includes removal of the items of merchandise from the shelf, uncoupling the shelf from the vertical members, raising or lowering the shelf to the desired level, and then, once again, coupling the shelf to the vertical members at the selected position, and replacing the previously removed items.

The present invention provides an improvement in apparatus and method for facilitating the placement of shelving at selected levels within such merchandise display and dispensing units. As such, the present invention attains several objects and advantages, some of which are summarized as follows: Enables convenience and effective selection of the vertical location of a shelf in a merchandise display and dispensing shelving unit; facilitates manual placement of a shelf at a selected level within a shelving unit with increased ease, without requiring unloading or reloading of the shelf; maintains a horizontal, level orientation of a display shelf while manually moving a loaded display shelf to a selected height in a shelving unit; provides conveniently located hand engagement sections for selective manual movement of a display and dispensing shelf, whether loaded or unloaded, to a desired elevation; enables manual movement of a display and dispensing shelf to a selected level with safety against unwanted accelerated downward movement upon being released for relocation; provides an unobtrusive, compact location and arrangement of component parts in an apparatus for effecting selective placement of shelving at selected levels in a merchandise display and dispensing unit; conserves time and expense in altering a display and dispensing unit to accommodate an effective display of a variety of items of merchandise; provides apparatus constructed for exemplary service over an extended service life.

The above objects and advantages, as well as further objects and advantages, are attained by the present invention which may be described briefly as apparatus for facilitating the placement of shelving at selected levels in a merchandise display and dispensing unit wherein at least one display shelf is secured in place in a horizontal, level orientation at a selected level to locate a corresponding point-of-purchase at a selected height within the merchandise display and dispensing unit, the display shelf having longitudinally spaced apart opposite ends, a proximal edge juxtaposed with the point-of-purchase, and a distal edge spaced laterally from the proximal edge, the apparatus comprising: a vertical support comprising a vertical member located adjacent each end of the display shelf; a pair of leveling members, each leveling member being carried by the display shelf adjacent a corresponding end of the display shelf and being engaged with a corresponding vertical member; a coupling member carried by the display shelf and coupling the leveling members for simultaneous rotation along the corresponding vertical member such that upon vertical movement of the display shelf, the display shelf is maintained in the horizontal, level orientation; and a locking mechanism having a locking member carried by the display shelf adjacent the distal edge for selective engagement with the vertical support to secure the display shelf at a selected level, and an actuator coupled with the locking member for selective disengagement of the locking member from the vertical support to release the display shelf for movement to another selected level; the actuator comprising engagement sections extending from adjacent one to adjacent the other of the opposite ends of the display shelf, the engagement sections being located beneath the display shelf, intermediate the proximal and distal edges of the display shelf, in place for convenient access from the proximal edge of the display shelf, enabling engagement by an operator for manual actuation to effect support of the display shelf from beneath the display shelf and manual movement of the display shelf to a selected level, without disturbing merchandise placed upon the display shelf.

In addition, the invention provides apparatus for facilitating the placement of shelving at selected levels in a merchandise display and dispensing unit wherein at least one display shelf is secured in place in a horizontal, level orientation at a selected level to locate a corresponding point-of-purchase at a selected height within the merchandise display and dispensing unit, the display shelf having longitudinally spaced apart opposite ends, a proximal edge juxtaposed with the point-of-purchase, and a distal edge spaced laterally from the proximal edge, the apparatus comprising: a vertical support located adjacent the display shelf; a locking mechanism having a locking member carried by the display shelf adjacent the distal edge for selective engagement with the vertical support to secure the display shelf at a selected level; an actuator coupled with the locking member for selective disengagement of the locking member to release the display shelf for movement to another selected level; and a damper mechanism coupling the display shelf with the vertical support for impeding accelerated downward movement of the display shelf while enabling controlled manual movement of the display shelf selectively downward and upward upon disengagement of the locking member to release the display shelf for relocation to another level.

Further, the present invention provides a method for facilitating the placement of shelving at selected levels in a merchandise display and dispensing unit wherein at least one display shelf is secured in place in a horizontal, level orientation at a selected level to locate a corresponding point-of-purchase at a selected height within the merchandise display and dispensing unit, the display shelf having longitudinally spaced apart opposite ends, a proximal edge juxtaposed with the point-of-purchase, and a distal edge spaced laterally from the proximal edge, the method comprising: locating a vertical member adjacent each end of the display shelf; placing a leveling member adjacent each end of the display shelf and engaging each leveling member with a corresponding vertical member; coupling the leveling members for simultaneous rotation, each along a corresponding vertical member such that upon vertical movement of the display shelf, the display shelf is maintained in the horizontal, level orientation; and placing a locking member on the display shelf adjacent the distal edge, for selective engagement with the vertical support to secure the display shelf at a selected level, and coupling an actuator with the locking member for selective disengagement of the locking member from the vertical support to release the display shelf for movement to another selected level; extending engagement sections from adjacent one to adjacent the other of the opposite ends of the display shelf, and placing the engagement sections beneath the display shelf, intermediate the proximal and distal edges of the display shelf, in place for convenient access from the proximal edge of the display shelf, enabling engagement by an operator for manual actuation to effect support of the display shelf from beneath the display shelf and manual movement of the display shelf to a selected level, without disturbing merchandise placed upon the display shelf.

Still further, the present invention provides a method for facilitating the placement of shelving at selected levels in a merchandise display and dispensing unit wherein at least one display shelf is secured in place in a horizontal, level orientation at a selected level to locate a corresponding point-of-purchase at a selected height within the merchandise display and dispensing unit, the display shelf having longitudinally spaced apart opposite ends, a proximal edge juxtaposed with the point-of-purchase, and a distal edge spaced laterally from the proximal edge, the method comprising: locating a vertical support adjacent the display shelf; placing a locking member on the display shelf adjacent the distal edge, for selective engagement with the vertical support to secure the display shelf at a selected level; coupling an actuator coupled with the locking member for selective disengagement of the locking member to release the display shelf for movement to another selected level; and coupling a damper mechanism with the display shelf and the vertical support for impeding accelerated downward movement of the display shelf while enabling controlled manual movement of the display shelf selectively downward and upward upon disengagement of the locking member to release the display shelf for relocation to another level.

The invention will be understood more fully, while still further objects and advantages will become apparent, in the following detailed description of preferred embodiments of the invention, in which.

Figure 1:
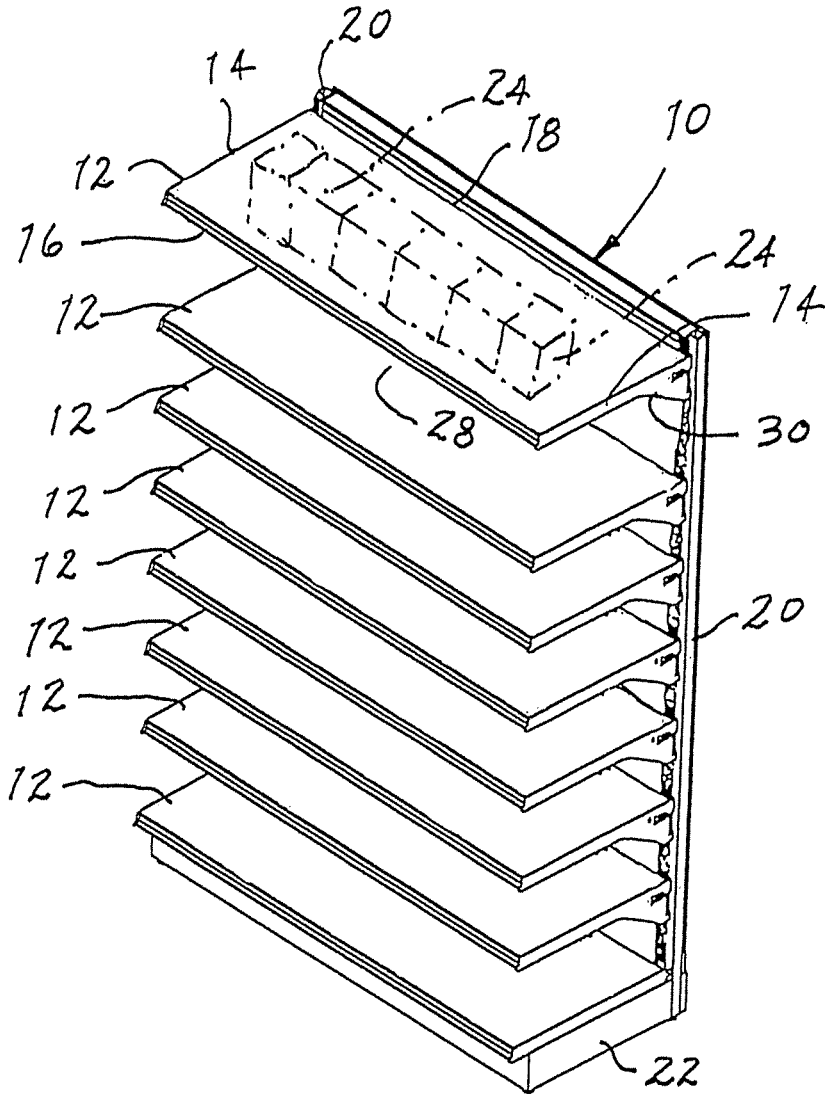
FIG. 1 is a top, front and right side pictorial view of a shelving unit constructed in accordance with the present invention.
Figure 2:
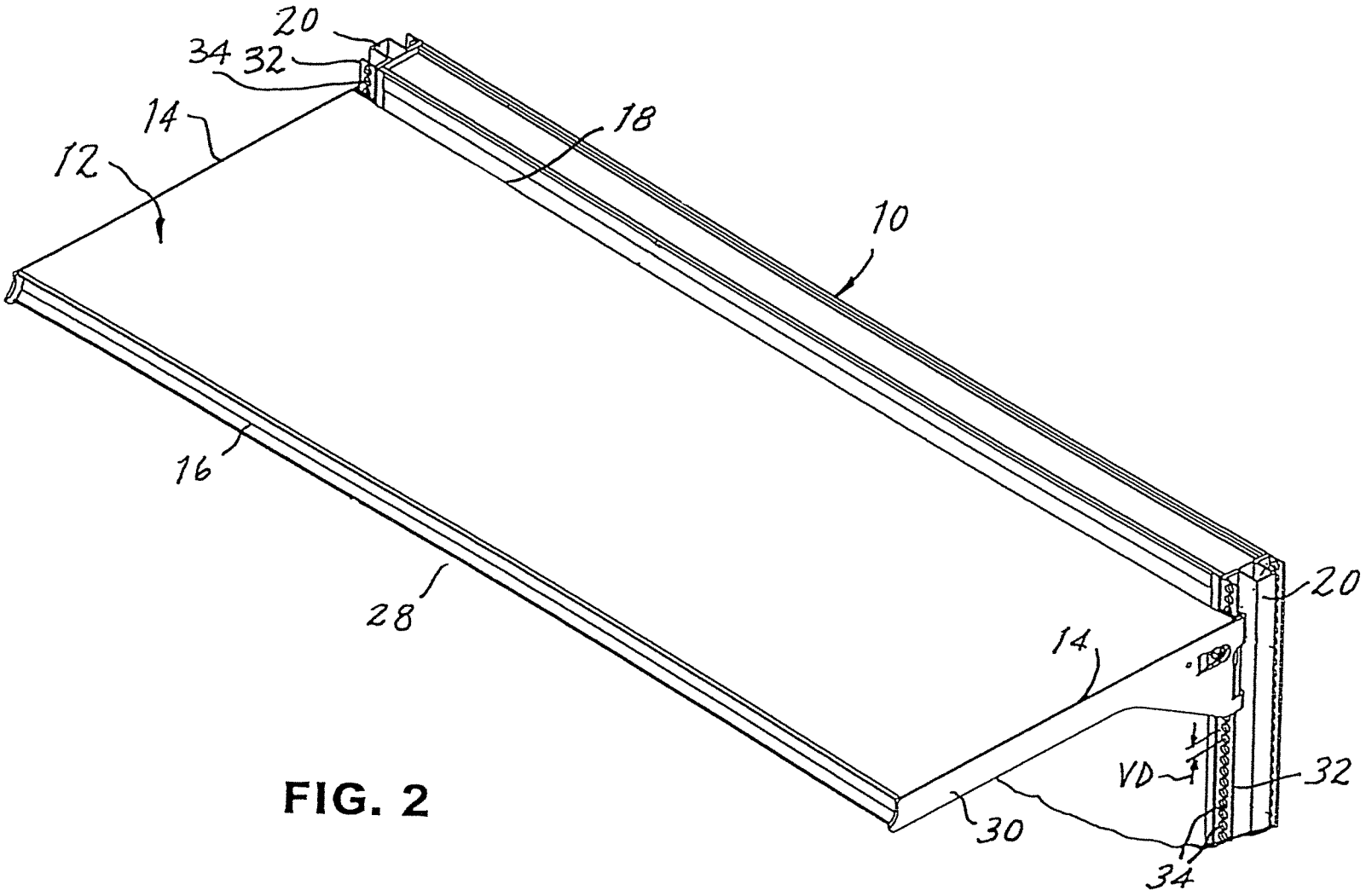
FIG. 2 is an enlarged fragmentary pictorial view of a portion of FIG. 1.
Figure 3:
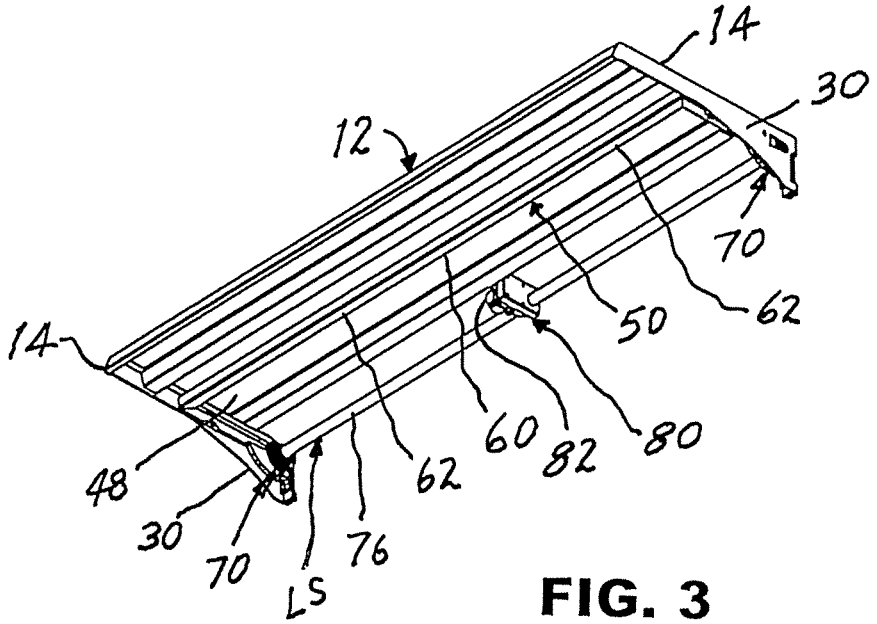
FIG. 3 is a bottom pictorial view of one shelf of those illustrated in FIG. 1.
Figure 4:
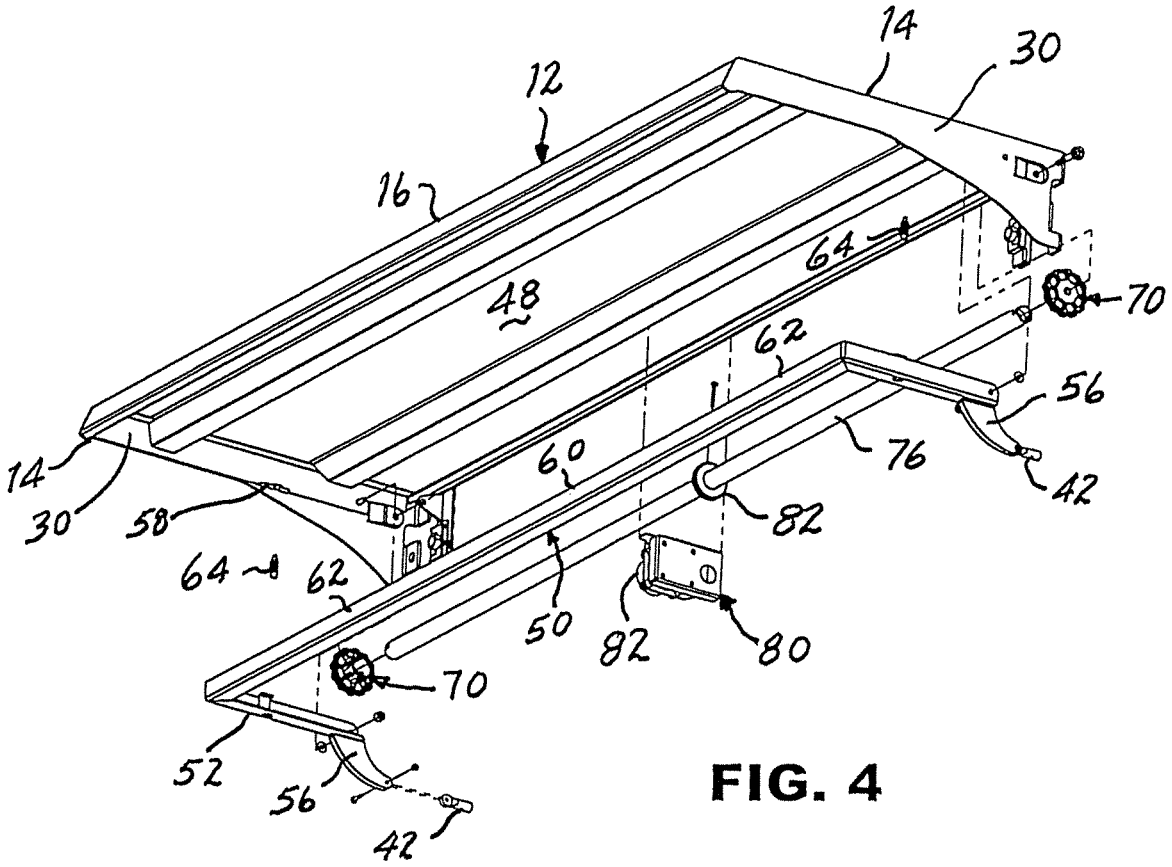
FIG. 4 is an exploded bottom pictorial view of the shelf depicted in FIG. 3.
Figure 5:
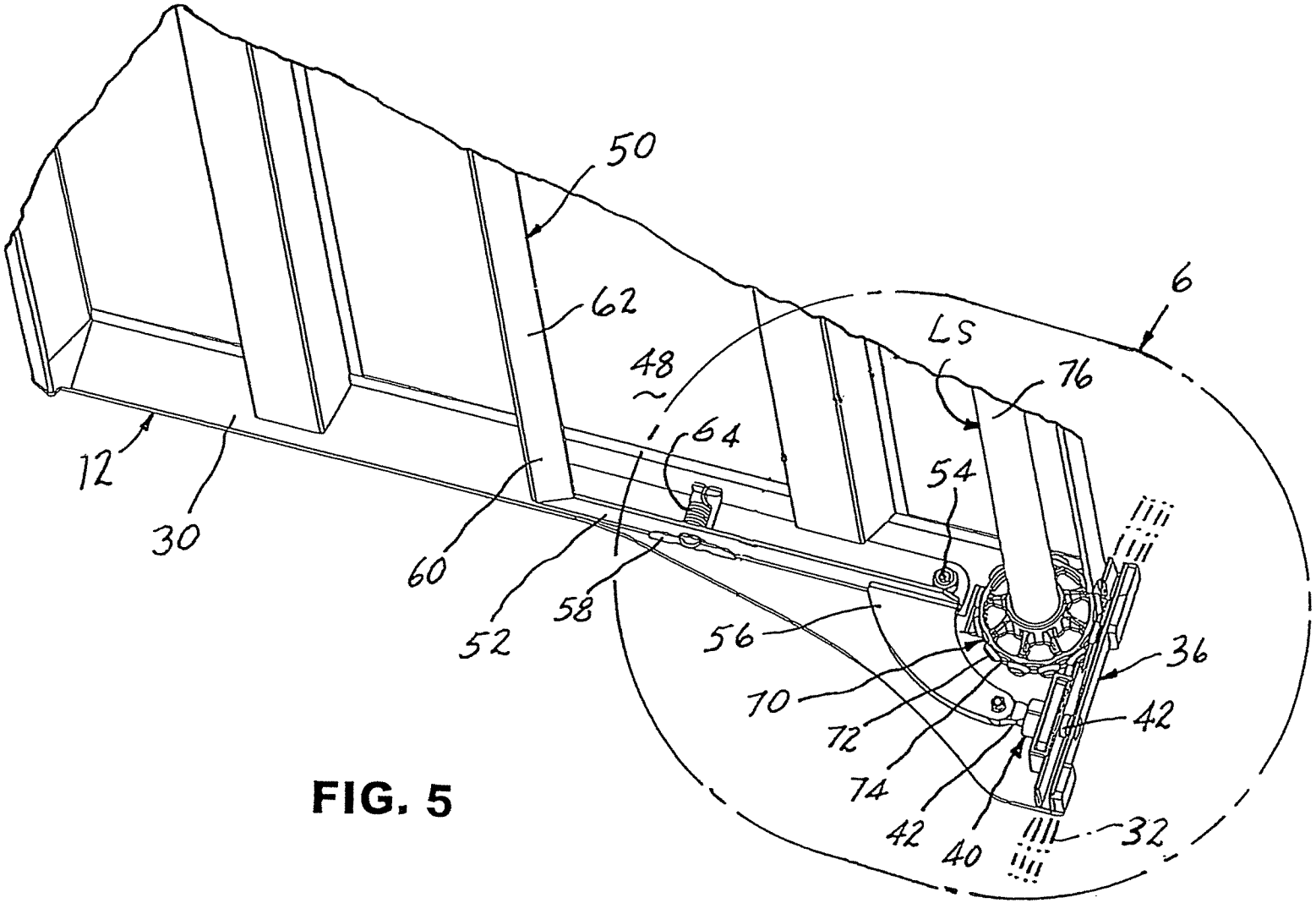
FIG. 5 is an enlarged fragmentary view of one end of the shelf depicted in FIG. 3, showing the component parts in one operating position.
Figure 6:
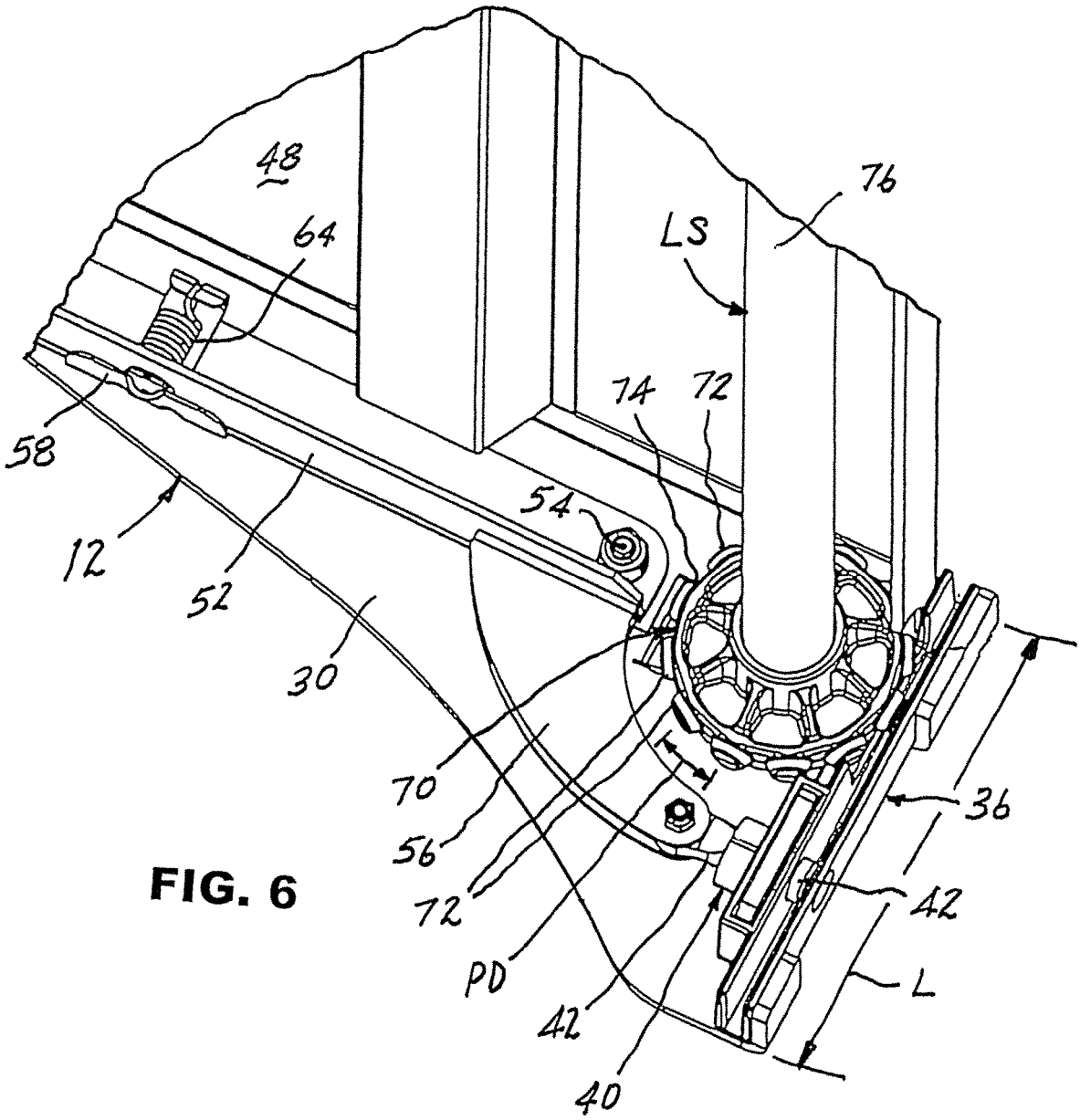
FIG. 6 is a further enlarged fragmentary view of a portion of FIG. 5 indicted by arrow 6.
Figure 7:
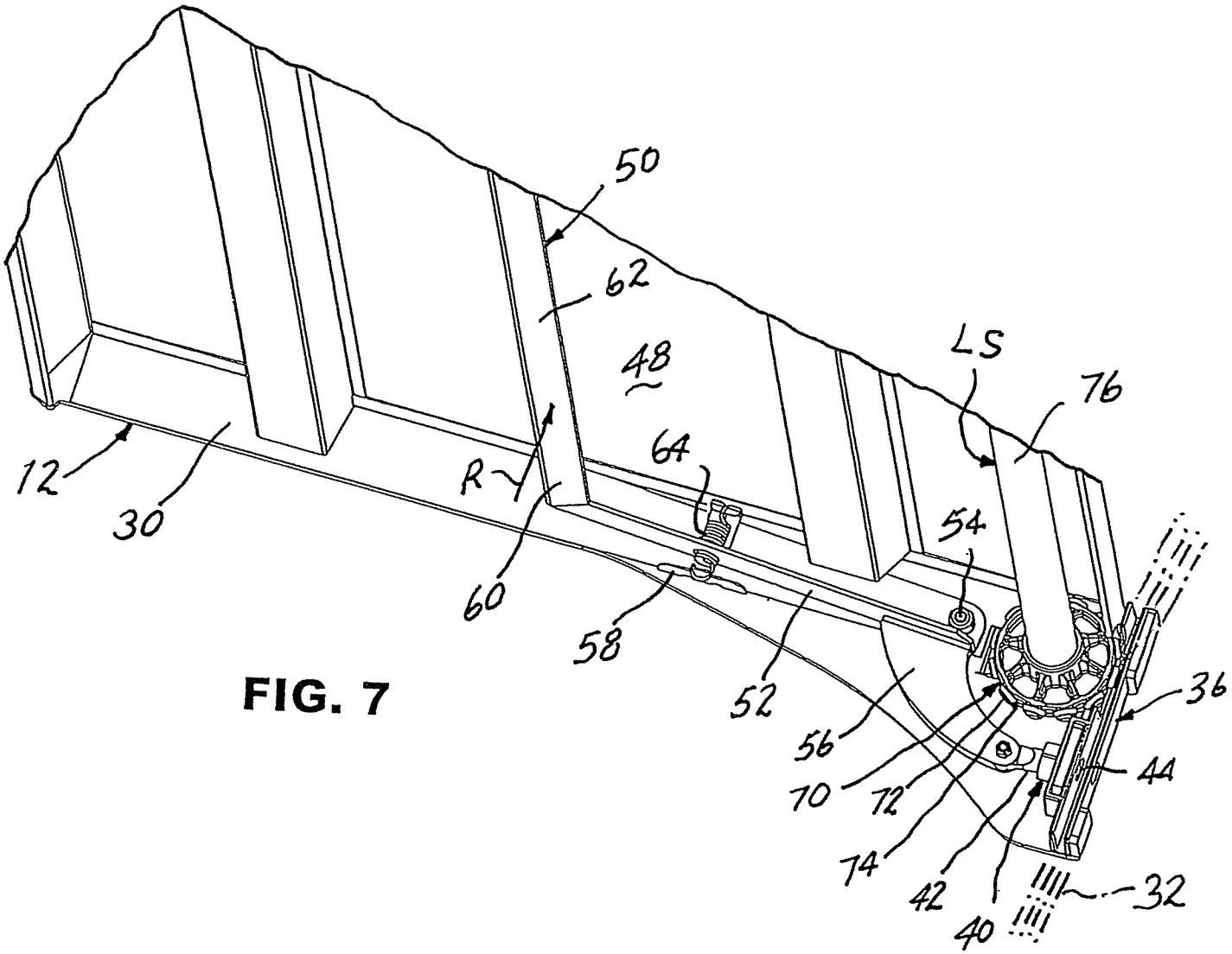
FIG. 7 is an enlarged fragmentary view similar to FIG. 5 and showing the component parts in another operating position.

Referring now to the drawing, and especially to FIGS. 1 and 2 thereof, a merchandise display and dispensing shelving unit is shown in the form of a gondola 10 having a plurality of display shelves 12, each shelf 12 extending longitudinally between opposite ends 14, and laterally between a proximal edge 16 and a distal edge 18. The shelves 12 are arrayed attitudinally along a vertical support shown in the form of vertical members 20 affixed to a base 22 and located one adjacent each end 14 of each shelf 12. Each display shelf 12 is secured in place in a horizontal, level orientation at a selected height and carries merchandise, some of which is illustrated in the form of items shown in phantom at 24, for presentation at a corresponding point-of-purchase 28 juxtaposed with the proximal edge 16 of each shelf 12, in a conventional manner. Each shelf 12 includes a bracket 30 integrated at a corresponding end 14 and securing the shelf 12 to the vertical members 20 at the distal edge 18 of the shelf 12 such that the shelf 12 is mounted in a cantilever manner at a selected height within the gondola 10.

Turning now to FIGS. 3 through 7, as well as to FIGS. 1 and 2, each vertical member 20 includes a rail 32 having a series of locking apertures 34 extending serially along each vertical member 20 and spaced apart from one-another by a fixed vertical distance VD. Each bracket 30 includes an integral slide 36 engaged with a corresponding rail 32, enabling the shelf 12 to be supported between vertical members 20 for sliding movement along the vertical members 20. A locking mechanism 40 includes a locking member shown in the form of a locking pin 42 aligned with an opening 44 in slide 36 such that upon registering opening 44 with a selected locking aperture 34, the locking pin 42 is advanced through opening 44 and into locking aperture 34 to secure slide 36 and, consequently, bracket 30 and shelf 12, in place at the level determined by the height of the selected locking aperture 34. Slide 36 is provided with a length L sufficient to assure stable support of shelf 12 during movement of the shelf 12 to a selected level, as well as when locked in place at the selected level.

Each bracket 30 carries a locking mechanism 40 at each of the opposite ends 14 of a shelf 12, and the locking mechanisms 40 are actuated simultaneously by an actuator 50 carried beneath the shelf 12 and nested in a compact arrangement between the brackets 30, in juxtaposition with the underside 48 of the shelf 12 so as not to intrude upon the space between attitudinally adjacent shelves 12, which space is reserved for the placement of items of merchandise offered for selection at a corresponding point-of-purchase. Actuator 50 includes a lever shown in the form of an arm 52 mounted upon each bracket 30 for pivotal movement about an axle 54 and carrying a link 56 coupled with a corresponding locking pin 42. Each arm 52 is supported in the compact, nested position illustrated in FIG. 5 by a stop 58 and reaches to a bar 60 extending longitudinally from one to the other of the arms 52, thereby extending essentially from one to the other of the brackets 30 and the respective opposite ends 14 of the shelf 12. Thus, bar 60 provides hand-engagement sections 62 placed conveniently with respect to the proximal edge 16 of shelf 12 so that an operator (not shown), is able easily to reach and manually engage the bar 60, so as to raise the bar 60, as indicated by arrow R in FIG. 7, for actuation of both locking mechanisms 40 simultaneously to withdraw each locking pin 42 from a corresponding locking aperture 34 while, at the same time, enabling an essentially balanced manual support of the shelf 12 while effecting movement of the shelf 12 to a selected level, without requiring removal of, or otherwise disturbing, items 24 placed on the shelf 12 in order to execute the move. Upon release of bar 60, a return spring 64 returns bar 60 to the nested position against stop 58, thereby assuring return of each locking pin 42 into engagement within a corresponding locking aperture 34 and concomitant securement of corresponding shelf 12 at the selected level.

In order to accomplish movement of a shelf 12 to a selected level, as described above, without requiring removal or effecting a disturbance of items 24 of merchandise placed on the shelf 12, thereby conserving time and effort, each shelf 12 is provided with a leveling system LS for assuring that the shelf 12 is maintained in the desired horizontal, level orientation during movement of the shelf 12 to a selected level. The leveling system LS includes a pair of leveling members comprised of toothed wheels shown in the form of cog wheels 70, each aligned and registered with a corresponding rail 32 of a vertical member 20, and each having a plurality of teeth, shown in the form of cogs 72 projecting radially from the periphery 74 of each cog wheel 70 and spaced apart a peripheral distance PD so related to the vertical distance VD between the locking apertures 34 as to sequentially engage the locking apertures 34 as each cog wheel 70 traverses an engaged rail 32. Each cog wheel 70 is journaled for rotation upon a corresponding bracket 30, and the cog wheels 70 are coupled together for simultaneous rotation, by a coupling member shown in the form of a tubular shaft 76 extending along the shelf 12 adjacent the distal edge 18 of the shelf 12. Simultaneous rotation of the cog wheels 70 maintains the ends 14 of the shelf 12 at the same height during vertical movement of the shelf 12 and, consequently, in concert with length L of each slide 36, maintains the desired horizontal, level orientation of the shelf 12 as the elevation of the shelf 12 is changed.

Thus, as illustrated and described herein, when it becomes necessary or desirable to move a shelf 12 from one level to another selected height in gondola 10, all that an operator need do is engage the shelf 12 at the underside 48, from adjacent the proximal edge 16 of the shelf 12 while, at the same time, supporting the shelf 12 and engaging the bar 60 of the actuator 50, at any conveniently located position or positions along the engagement sections 62 between the opposite ends 14 of the shelf 12, to unlock both locking mechanisms 40 simultaneously, thereby releasing the shelf 12 for movement along vertical members 20, while enabling the operator to move the shelf 12 in an essentially balanced fashion, without requiring the removal of items 24 from the shelf 12 and, by virtue of the leveling system LS, maintaining the desired horizontal, level orientation of the shelf 12 so as not to disturb items 24 on the shelf 12.

In order to preclude an undesirable or even dangerous accelerated downward movement of a shelf 12 along vertical members 20, upon unlocking corresponding locking mechanisms 40, especially where the unlocked shelf 12 is loaded with items 24, each shelf 12 is provided with a damper mechanism 80, such as a rotary damper mechanism made commercially available by Ace Controls, associated with each shelf 12 and coupled with the vertical members 20, preferably by being affixed to the underside 48 of each shelf 12 and coupled with shaft 76 of a corresponding leveling system LS by a geartrain 82 such that downward acceleration is impeded, while a manually controlled downward movement, as well as a manually controlled upward movement, is enabled for selective relocation of a shelf 12.

It will be seen that the present invention attains all of the objects and advantages summarized above, namely: Enables convenience and effective selection of the vertical location of a shelf in a merchandise display and dispensing shelving unit; facilitates manual placement of a shelf at a selected level within a shelving unit with increased ease, without requiring unloading or reloading of the shelf; maintains a horizontal, level orientation of a display shelf while manually moving a loaded display shelf to a selected height in a shelving unit; provides conveniently located hand engagement sections for selective manual movement of a display and dispensing shelf, whether loaded or unloaded, to a desired elevation; enables manual movement of a display and dispensing shelf to a selected level with safety against unwanted accelerated downward movement upon being released for relocation; provides an unobtrusive, compact location and arrangement of component parts in an apparatus for effecting selective placement of shelving at selected levels in a merchandise display and dispensing unit; conserves time and expense in altering a display and dispensing unit to accommodate an effective display of a variety of items of merchandise; provides apparatus constructed for exemplary service over an extended service life.

It is to be understood that the above description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. Apparatus for facilitating the placement of shelving at selected levels in a merchandise display and dispensing unit wherein at least one display shelf is secured in place in a horizontal, level orientation at a selected level to locate a corresponding point-of-purchase at a selected height within the merchandise display and dispensing unit, the display shelf having longitudinally spaced apart opposite ends, a proximal edge juxtaposed with the point-of-purchase, and a distal edge spaced laterally from the proximal edge, the apparatus comprising:

a vertical support comprising a vertical member located adjacent each end of the display shelf;

a pair of leveling members, each leveling member being carried by the display shelf adjacent a corresponding end of the display shelf and being engaged with a corresponding vertical member;

a coupling member carried by the display shelf and coupling the leveling members for simultaneous rotation along the corresponding vertical member such that upon vertical movement of the display shelf, the display shelf is maintained in the horizontal, level orientation; and a locking mechanism having a locking member carried by the display shelf adjacent the distal edge for selective engagement with the vertical support to secure the display shelf at a selected level, and an actuator coupled with the locking member for selective disengagement of the locking member from the vertical support to release the display shelf for movement to another selected level;

the actuator comprising engagement sections extending one to the other of the opposite ends of the display shelf, the engagement sections being located beneath the display shelf, intermediate the proximal and distal edges of the display shelf, in place for convenient access from the proximal edge of the display shelf, enabling engagement by an operator for manual actuation to effect support of the display shelf from beneath the display shelf and manual movement of the display shelf to a selected level, without disturbing merchandise placed upon the display shelf.

2. The apparatus of claim 1 including a series of apertures spaced apart a vertical distance extending serially along each vertical member, and wherein each said locking member is associated with a respective said vertical member, each said locking member comprising a locking pin movable between an engaged position wherein the locking pin is inserted into a corresponding aperture to secure the display shelf at a selected level, and a disengaged position wherein the locking pin is retracted from such corresponding aperture to permit manual movement of the display shelf to another selected level.

3. The apparatus of claim 2 wherein the actuator includes a lever having a bar carrying the engagement sections and extending substantially from one to the other of the opposite ends of the display shelf, intermediate the proximal and distal edges of the display shelf, beneath the display shelf, for convenient access to the engagement sections from the proximal edge for being engaged for manual movement to actuate each locking pin simultaneously between the corresponding engaged and disengaged positions.

4. The apparatus of claim 3 wherein the leveling members each comprise a toothed wheel having a periphery and a plurality of teeth projecting radially from the periphery and spaced apart a peripheral distance related to the vertical distance between the locking apertures, the toothed wheels each being aligned with a corresponding one of the vertical members such that as the display shelf is moved in vertical directions, the teeth of each toothed wheel will engage corresponding apertures in each vertical member to maintain the display shelf in the horizontal, level orientation.

5. The apparatus of claim 3 including a bracket at each of the opposite ends of the display shelf, each bracket extending between a proximal end and a distal end, each bracket being integrated with the display shelf, and a linkage carried by each bracket and coupling the locking member of a corresponding said locking mechanism with the lever for simultaneous actuation of each locking member in response to movement of the bar.

6. The apparatus of claim 5 wherein the actuator is nested between the brackets, and a stop is located on at least one of the brackets in place to preclude displacement of the actuator beyond being nested between the brackets.

7. The apparatus of claim 5 wherein the leveling members each comprise a toothed wheel having a periphery and a plurality of teeth projecting radially from the periphery and spaced apart a peripheral distance related to the vertical distance between the locking apertures, the toothed wheels each being aligned with a corresponding one of the vertical members such that as the display shelf is moved in vertical directions, the teeth of each toothed wheel will engage corresponding apertures in each vertical member to maintain the display shelf in the horizontal, level orientation.

8. The apparatus of claim 1 including a damper mechanism coupling the display shelf and the vertical support for impeding accelerated downward movement of the display shelf while enabling controlled manual movement of the display shelf selectively downward and upward upon disengagement of the locking member to release the display shelf for relocation to another level.

9. The apparatus of claim 8 wherein the damper mechanism is carried by the display shelf.

10. The apparatus of claim 9 wherein the damper mechanism is coupled with the leveling mechanism.

* * * * *